US007929006B2

(12) United States Patent
Shibuya

(10) Patent No.: US 7,929,006 B2
(45) Date of Patent: Apr. 19, 2011

(54) NONPARALLEL BEAM SCANNING APPARATUS FOR LASER PRINTER

(75) Inventor: Takeshi Shibuya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 81 days.

(21) Appl. No.: 12/392,428

(22) Filed: Feb. 25, 2009

(65) Prior Publication Data

US 2009/0225151 A1 Sep. 10, 2009

(30) Foreign Application Priority Data

Mar. 4, 2008 (JP) ..... 2008-053805
Feb. 9, 2009 (JP) ..... 2009-027557

(51) Int. Cl.
*B41J 2/45* (2006.01)

(52) U.S. Cl. ..... 347/238

(58) Field of Classification Search ..... 347/116, 347/229, 234, 235, 248–250, 233, 237, 238, 347/247

See application file for complete search history.

(56) References Cited

U.S. PATENT DOCUMENTS 4,435,064 A * 3/1984 Tsukada et al. ..... 355/1
6,118,463 A * 9/2000 Houki et al. ..... 347/116
7,443,559 B2 * 10/2008 Kim et al. ..... 359/206.1

FOREIGN PATENT DOCUMENTS

JP 5-83503 4/1993
JP 7-32647 2/1995
JP 9-52389 2/1997
JP 2000263845 A * 9/2000
JP 2001-264657 9/2001
JP 2004-276532 10/2004
JP 2006-142787 6/2006
JP 3826666 7/2006
JP 2006-255958 9/2006
JP 2007-145001 6/2007
JP 2007-168236 7/2007

* cited by examiner

*Primary Examiner* — Hai C Pham

(74) *Attorney, Agent, or Firm* — Oblon, Spivak, McClelland, Maier & Neustadt, L.L.P.

(57) ABSTRACT

A disclosed image forming apparatus includes a laser array light source having plural laser light sources for generating plural laser beams; a photosensitive body having a surface on which an electrostatic latent image is formed by a surface potential changed by the plural laser beams emitted from the laser array light source; and a controller for controlling emission of the plural laser beams of the laser array light source. The controller sequentially turns off at least one of the plural laser beams when forming a continuous electrostatic latent image line on the photosensitive body by scanning the plural laser beams in a main scanning direction of the photosensitive body.

7 Claims, 14 Drawing Sheets

FIG.6

| INPUT | OUTPUT | | | | | | | |
|---|---|---|---|---|---|---|---|---|
| 00 | 0000 | 0000 | 0000 | 0000 | 0000 | 0000 | 0000 | 0000 |
| 01 | 0000 | 0000 | 0000 | 0001 | 1111 | 1111 | 1111 | 1111 |
| 10 | 1111 | 1111 | 1111 | 1111 | 1000 | 0000 | 0000 | 0000 |
| 11 | 1111 | 1111 | 1111 | 1111 | 1111 | 1111 | 1111 | 1111 |

260

FIG.15

| INPUT | OUTPUT | | | | | | | |
|---|---|---|---|---|---|---|---|---|
| 0000 | 0000 | 0000 | 0000 | 0000 | 0000 | 0000 | 0000 | 0000 |
| 0001 | 0000 | 0000 | 0000 | 0000 | 0000 | 0011 | 1111 | 1111 |
| 0010 | 0000 | 0000 | 0000 | 0001 | 1111 | 1111 | 1000 | 0000 |
| 0011 | 0000 | 0000 | 0000 | 0001 | 1111 | 1111 | 1111 | 1111 |
| 0100 | 0000 | 0001 | 1111 | 1111 | 1000 | 0000 | 0000 | 0000 |
| 0101 | 0000 | 0000 | 1111 | 1111 | 0000 | 0000 | 1111 | 1111 |
| 0110 | 0000 | 0000 | 1111 | 1111 | 1111 | 1111 | 0000 | 0000 |
| 0111 | 0000 | 0000 | 1111 | 1111 | 1111 | 1111 | 1111 | 1111 |
| 1000 | 1111 | 1111 | 1100 | 0000 | 0000 | 0000 | 0000 | 0000 |
| 1001 | 1111 | 1111 | 0000 | 0000 | 0000 | 0000 | 1111 | 1111 |
| 1010 | 1111 | 1111 | 0000 | 0000 | 1111 | 1111 | 0000 | 0000 |
| 1011 | 1111 | 1110 | 0000 | 0000 | 0111 | 1111 | 1111 | 1111 |
| 1100 | 1111 | 1111 | 1111 | 1111 | 1000 | 0000 | 0000 | 0000 |
| 1101 | 1111 | 1111 | 1111 | 1110 | 0000 | 0000 | 0111 | 1111 |
| 1111 | 1111 | 1111 | 1111 | 1111 | 1111 | 1111 | 1111 | 1111 |

260

NONPARALLEL BEAM SCANNING APPARATUS FOR LASER PRINTER

BACKGROUND OF THE INVENTION

1. Field of the Invention

The present invention generally relates to an image forming apparatus having a laser array light source.

2. Description of the Related Art

Conventionally, electrophotographic image forming apparatuses have employed a scanning optical method to form a scanning line on a photosensitive body by irradiating a rotating polygon mirror with a laser beam to scan onto the photosensitive body. However, the number of rotations, response speeds of beam pulses and the photosensitive body, and the like of this scanning optical method are not becoming high enough to meet market demands for electrophotography at higher speed.

Therefore, an edge emitting type array laser head having plural light emitting units provided linearly as disclosed in Patent Document 1 and a surface emitting type laser head having plural light emitting units arranged in a matrix as disclosed in Patent Document 2 are being developed as a laser device capable of emitting more laser beams at the same time.

When channels of laser beams are increased in such laser devices, distortions of an optical system such as skewed and bowed scanning lines, are generated. To solve these problems, there has been suggested a method to digitally correct a laser irradiation address by taking advantage of the fact that digital laser irradiation addresses can be formed more precisely (with smaller pitch) as disclosed in Patent Document 3.

The aforementioned method related to the correction of skew has been suggested not only for a scanning optical type electrophotographic apparatus, but also for an image forming apparatus which writes data of one raster all at once by using a long LED as disclosed in Patent Document 4. For the correction of skew, there has been also disclosed a method to moderate generation of a step in a line in a main scanning direction caused by the correction by distributing exposure strength between adjacent rasters, besides the aforementioned method.

Patent Document 5 discloses a configuration to repeat discontinuous exposure of each exposure area by one scan, by driving a semiconductor laser so that an exposed area and a non-exposed area periodically appear in each main scan, with a recording density in a main scanning direction set at 400 dpi and a recording density in a vertical direction set at 3200 dpi which is twice as high as that of a first embodiment thereof, in order to reduce a heating value by reducing a duty ratio, to suppress an effect by droop.

Patent Document 6 discloses a control method to shift an image in stages in a vertical scanning direction as a moving direction of a latent image support and shift an image at different positions in plural scanning for one scanning line in multiple exposure, or a control method to draw an image of image data on a printing unit by dividing the image data into plural parts with respect to a main scanning direction that is vertical to a moving direction of the latent image support so that a boundary between the parts is not linear in the vertical direction, and shifting the parts in the vertical scanning direction in stages.

Patent Document 1: Japanese Patent Application Publication No. 2001-264657

Patent Document 2: Japanese Patent Application Publication No. 2004-276532

Patent Document 3: Japanese Patent Application Publication No. 2007-168236

Patent Document 4: Japanese Patent Application Publication No. 2006-142787

Patent Document 5: Japanese Patent Application Publication No. 7-32647

Patent Document 6: Japanese Patent Application Publication No. 2006-255958

In the case of increasing the number of beam channels by using, for example, an array type laser head in Patent Documents 1 to 4, there is a problem in that changes in the amount of light (droop) are increased due to increased temperature of such light sources.

Moreover, when the number of beam channels is increased, the number of scanning lines scanned at the same time is increased. Therefore, the pitch of scanning becomes larger. As a result, there is a problem in that skew is increased. The problem of skew can be solved by digitally correcting laser irradiation addresses as in the conventional technique. To solve the problem of droop as well, however, a process to turn off each channel of the plural beam channels is also required in combination.

In the method disclosed in Patent Document 5, there are following problems. The method of Patent Document 5 cannot solve both correction of skew of a scanning line generated by multi-beam scanning, and elimination of droop. In particular, Patent Document 5 discloses a configuration in which two main scans corresponds to one scanning line. In this case, the duty ratio is limited to 50% at highest. There is no description in Patent Document 5 as to realizing a higher duty ratio without degrading quality of the scanning line.

Further, there is no description as to reducing droop in Patent Document 6, in which a method to reduce a defect involved with correction of skew is described.

SUMMARY OF THE INVENTION

The present invention has been made in view of the aforementioned circumstances and it is an object of at least one embodiment of the present invention to provide an image forming apparatus capable of reducing droop and moderating skew even when the number of beam channels is increased.

To achieve this object, the present invention employs a configuration as described below.

According to one aspect of the present invention, an image forming apparatus includes a laser array light source having plural laser light sources for emitting plural laser beams; a photosensitive body having a surface on which an electrostatic latent image is formed by a surface potential changed by the plural laser beams emitted from the laser array light source; and a controller for controlling emission of the plural laser beams of the laser array light source. The controller sequentially turns off at least one of the plural laser beams when forming a continuous electrostatic latent image line on the photosensitive body by scanning the plural laser beams in a main scanning direction of the photosensitive body.

According to one embodiment, droop can be reduced and skew can be moderated.

BRIEF DESCRIPTION OF THE DRAWINGS

FIG. 6 is a diagram showing an example of a γ table 260;

FIG. 15 is a diagram showing another example of the γ table 260.

DETAILED DESCRIPTION OF THE PREFERRED EMBODIMENTS

In an image forming apparatus of an embodiment of the present invention, by switching exposure times of plural laser beams emitted by a laser array light source, one electrostatic latent image line parallel to a scanning direction is formed on a photosensitive body. That is, in the image forming apparatus of the present invention, one continuous electrostatic latent image line is formed by sequentially turning off individual channels of the plural laser beams. Therefore, droop can be reduced and skew can be moderated.

Embodiment

Figure 1:
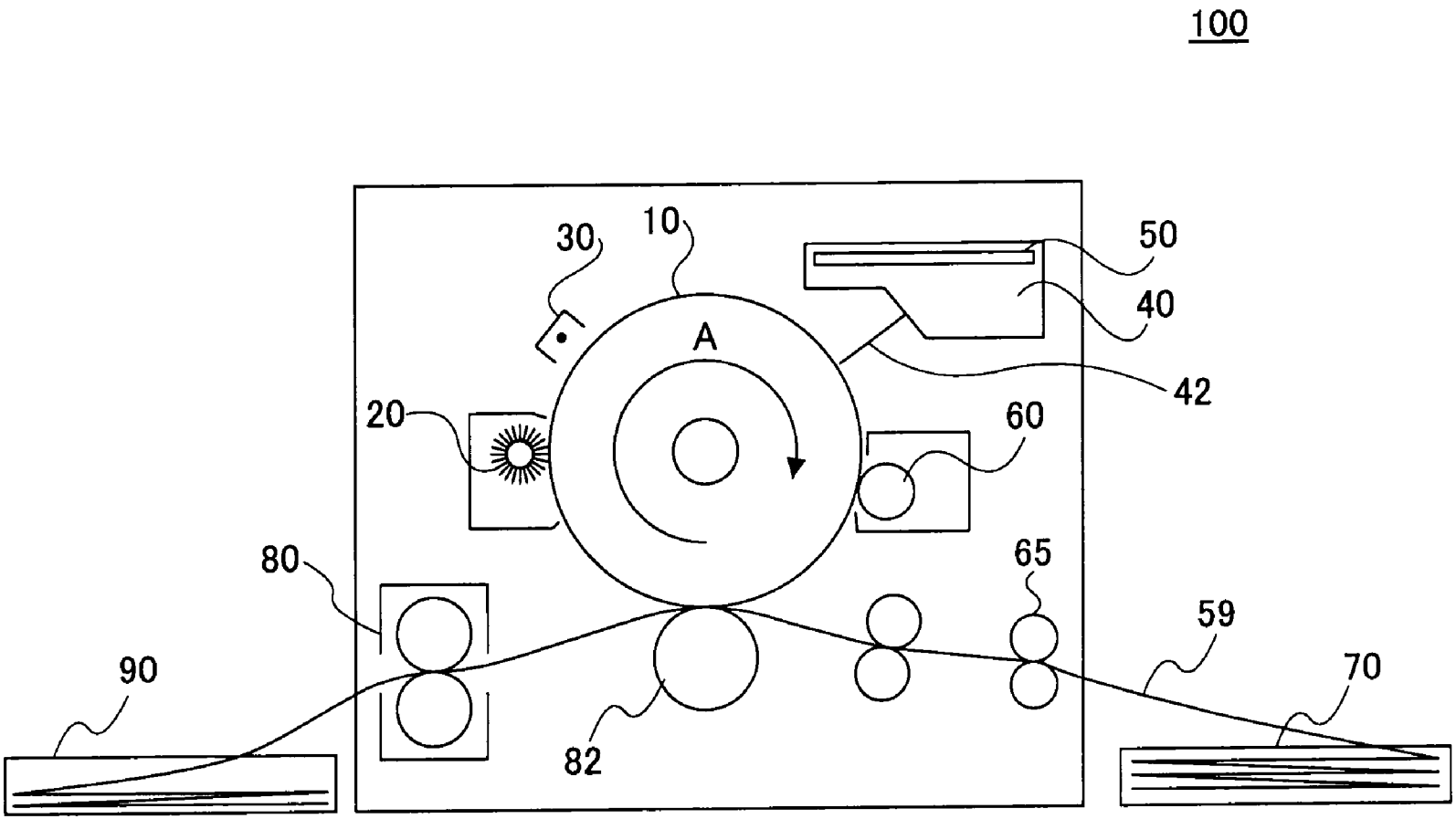
FIG. 1 is a schematic diagram showing an image forming apparatus 100 of the present invention.

Hereinafter, an embodiment of the present invention is described with reference to the drawings. FIG. 1 is a schematic diagram showing an image forming apparatus 100 of the present invention.

The image forming apparatus 100 includes a photosensitive drum 10, a cleaning roller 20, a charger 30, a laser unit 40, a controller 50, a developing roller 60, a paper supply stacker 70, a fixer 80, and a paper output stacker 90.

The photosensitive drum 10 rotates in the direction of arrow A shown in FIG. 1. A laser beam is emitted from the laser unit 40, and thereby an electrostatic latent image is formed on the photosensitive body drum 10. After a surface of the photosensitive body drum 10 is cleaned by the cleaning roller 20, the charger 30 charges the surface of the photosensitive body drum 10. The controller 50 controls the laser unit 40. The laser unit 40 turns on/off the laser beams 42 emitted in response to signals from the controller 50 so as to scan the surface of the photosensitive body drum 10.

The scanning direction of the laser beams 42 at this time is called a main scanning direction. The rotational direction A of the photosensitive body drum 10 is called a vertical scanning direction. Accordingly, a charge of an exposed part of the photosensitive body drum 10 is removed and an electrostatic latent image is formed. The formed electrostatic latent image is developed by toner supplied by the developing roller 60 to be formed into a toner image. A transfer roller 82 transfers the toner image onto recording paper supplied from the paper supply stacker 70. The fixer 80 fixes the toner image onto the recording paper by thermal compression bonding using a fixing roller. The recording paper with the image formed is outputted onto the paper output stacker 90.

Figure 2:
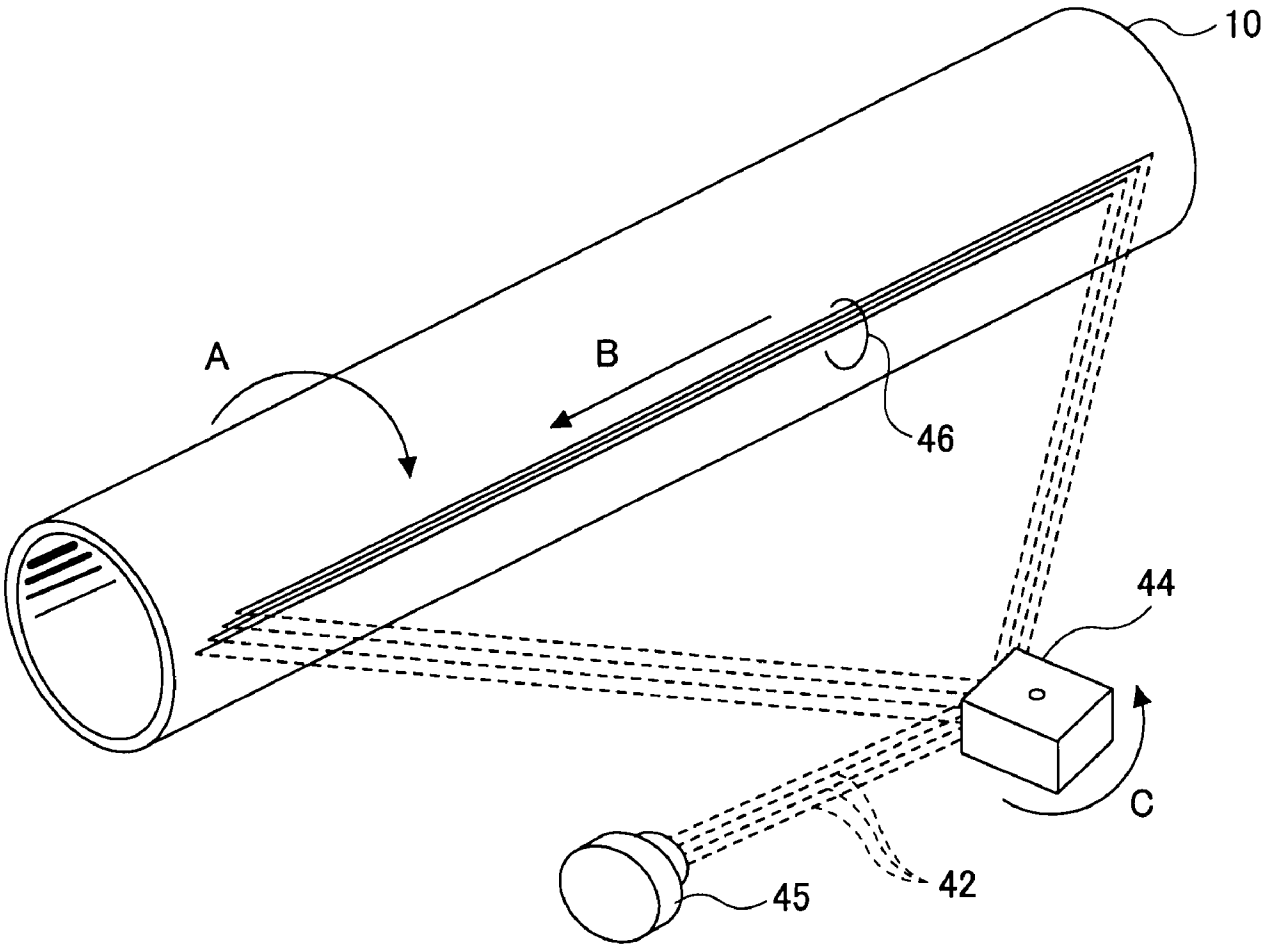
FIG. 2 is a conceptual diagram showing an optical scanning system of the image forming apparatus 100 of the present invention.

FIG. 2 is a schematic diagram showing an optical scanning system of the image forming apparatus 100 of the present invention.

In FIG. 2, an f-θ lens, mirrors to reflect a light path, and the like are omitted and the light path is simplified to show essential parts clearly. Originally, a polygon mirror 44 and an LDA (Laser Diode Array) 45 serving as a multi-channel laser array light source are housed with lenses, mirrors, and the like in the laser unit 40 shown in FIG. 1. Further, the charger 30, the developing roller 60, the transfer roller 82, the cleaning roller 20, and the like provided at the periphery of the photosensitive body drum 10 are omitted as well in FIG. 2.

In FIG. 2, the photosensitive body drum 10 rotates in the direction of arrow A (vertical scanning direction). The laser beams 42 emitted from the LDA 45 are reflected by the polygon mirror 44 which rotates in the direction of arrow C, thereby beam scanning lines 46 which are scanned in the direction of arrow B are formed on the photosensitive body drum 10. One beam scanning line 46 is formed over the photosensitive body drum 10 corresponding to each of the laser beams 42.

The laser beams 42, which form an electrostatic latent image on the photosensitive body drum 10, are emitted 40 in number (shown as four beams in FIG. 2) at the same time from the LDA 45. The LDA 45 of this embodiment is an edge emitting type LDA including 40 channels of lasers having output ends linearly provided at even intervals. The alignment direction of the laser output edges is arranged to be inclined with respect to the main scanning direction.

In this embodiment, by setting the LDA 45 to have a small inclined angle, the beam scanning lines 46 can be formed on the photosensitive body drum 10 at small intervals. Therefore, the intervals of the beam scanning lines 46 can be controlled by controlling the inclined angle.

Figure 3:
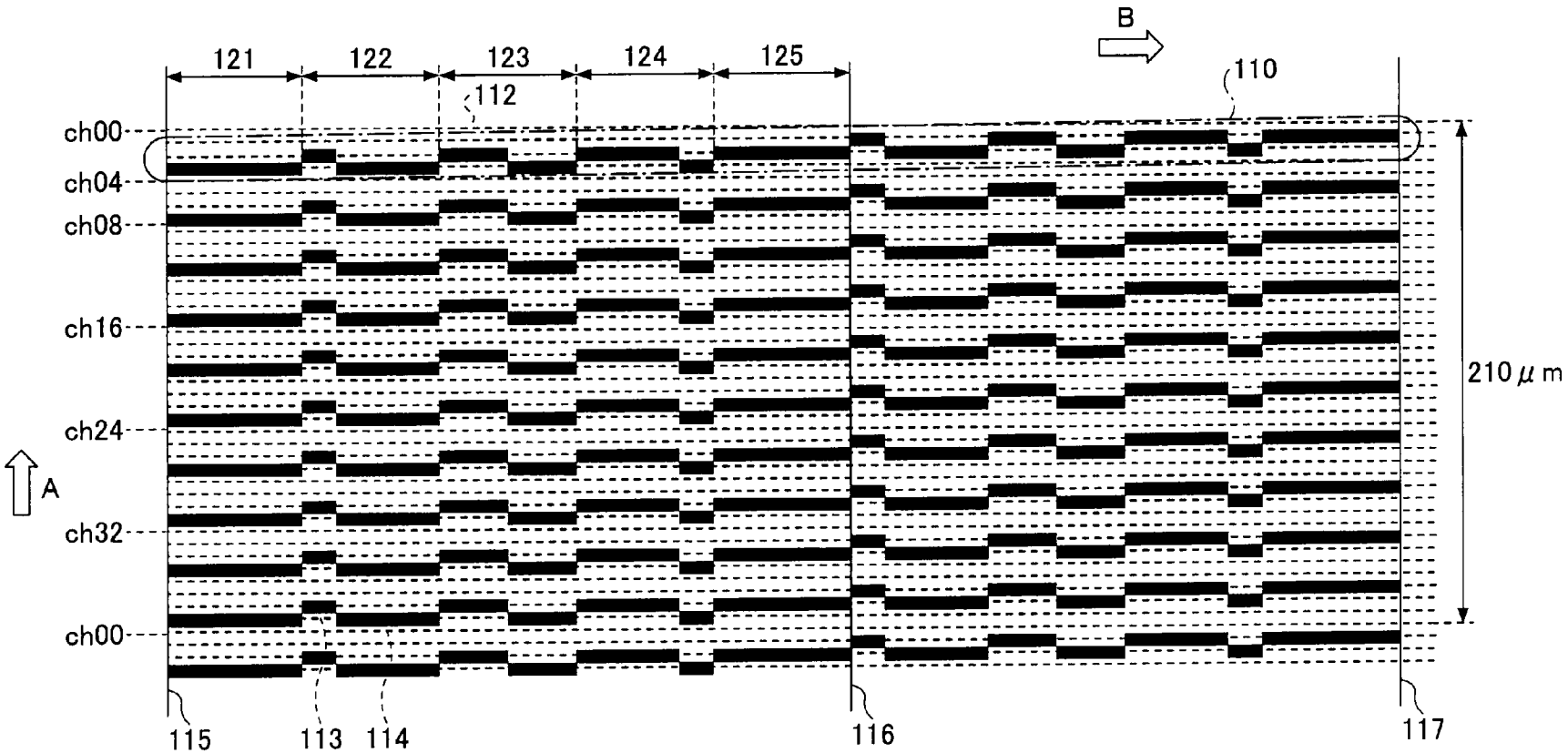
FIG. 3 is a diagram showing a relationship between a beam scanning line 46 and an electrostatic latent image line 110.

Below, a relationship between the beam scanning lines 46 and an electrostatic latent image line 110 in this embodiment is described. In the image forming apparatus 100 of this embodiment, irradiation time of the plural laser beams emitted from the LDA 45 is switched to form one electrostatic latent image line 110 parallel to the main scanning direction on the photosensitive body drum 10. FIG. 3 is a diagram showing a relationship between the beam scanning lines 46 and the electrostatic latent image line 110.

In this embodiment, one electrostatic latent image line 110 is formed of one group of four beam scanning lines formed by laser beams emitted at the same time.

In this embodiment, the laser beams 42 emitted from the LDA 45 are scanned in the direction of arrow B. The direction of arrow A is the rotational direction (vertical scanning direction) of the photosensitive body drum 10. In the following description of this embodiment, the vertical scanning direction is called a negative direction. However, the opposite direction of arrow A is a positive direction of the vertical scanning direction in FIG. 3 in consideration of the order of forming an image on the photosensitive body drum 10.

Each broken line in FIG. 3 denotes a scanning line scanned by one laser beam onto the photosensitive body drum 10. The forty scanning lines from broken line 112 to broken line 113 are beam scanning lines 46 scanned by the LDA 45 all at once. The beam scanning lines 46 correspond to channel outputs (denoted as ch00 through ch39) of the LDA 45 in order from broken line 112. A subsequent broken line 114 corresponds to ch00 drawn by subsequent scanning.

FIG. 3 shows the case of solid printing, where all pixels are turned on. The electrostatic latent image line 110 is formed by the laser beams ch00 through ch03. In FIG. 3, the electrostatic latent image line 110 is not drawn as a continuous line, however, the electrostatic latent image line 110 is formed as one continuous line. Forming the electrostatic latent image line 110 is described in detail below.

In FIG. 3, auxiliary lines 115 and 116 showing beam scanning positions are provided for description. An area between auxiliary lines 115 and 116 is divided in the vertical scanning direction into sections 121 through 125.

In this embodiment, in the area between auxiliary lines 115 and 116, the electrostatic latent image line 110 is formed by only the laser beam ch03 in section 121. Therefore, exposure energy of the laser beam ch03 is 100% in section 121. Note that other laser beams ch00 through ch02 are turned off during a period when the laser beam ch03 is emitted.

In section 122, the electrostatic latent image line 110 is formed by the laser beams ch02 and ch03. At this time, exposure energy of the laser beam ch02 is 25% while exposure energy of the laser beam ch03 is 75% in section 122. During a period when the laser beam ch02 is emitted, other laser beams ch00, ch01, and ch03 are turned off. Further, during a period when the laser beam ch03 is emitted, other laser beams ch00, ch01, and ch02 are turned off.

Although the electrostatic latent image line 110 is formed by the laser beams ch02 and ch03 in section 123 in a similar manner to that of section 122, the exposure energy of the laser beams ch02 and ch03 are set different from those for section 122. In section 123, the exposure energy of each of the laser beams ch02 and ch03 is 50%. Note that other laser beams ch00, ch01, and ch03 are turned off during a period when the laser beam ch02 is emitted. Moreover, during a period when the laser beam ch03 is emitted, other laser beams ch00, ch01, and ch02 are turned off.

Although the electrostatic latent image line 110 is formed by the laser beams ch02 and ch03 in section 124 in a similar manner to that of section 123, the exposure energy levels of the laser beams ch02 and ch03 are set different from those for the section 123. In section 124, the exposure energy of the laser beam ch02 is 75% while the exposure energy of the laser beam ch03 is 25%. Note that other laser beams ch00, ch01, and ch03 are turned off during a period when the laser beam ch02 is emitted. Further, during a period when the laser beam ch03 is emitted, other laser beams ch00, ch01, and ch02 are turned off.

In section 125, the electrostatic latent image line 110 is formed by only the laser beam ch02. Therefore, the exposure energy of the laser beam ch02 is 100% in section 125. Note that other laser beams ch00, ch01, and ch03 are turned off during a period when the laser beam ch02 is emitted.

The exposure energy for the sections can be controlled by a method to switch exposure intensity of each channel or a method to switch exposure time of each channel. In particular, the method to control the exposure energy by switching the exposure time of each channel is mainly described below.

Figure 4:
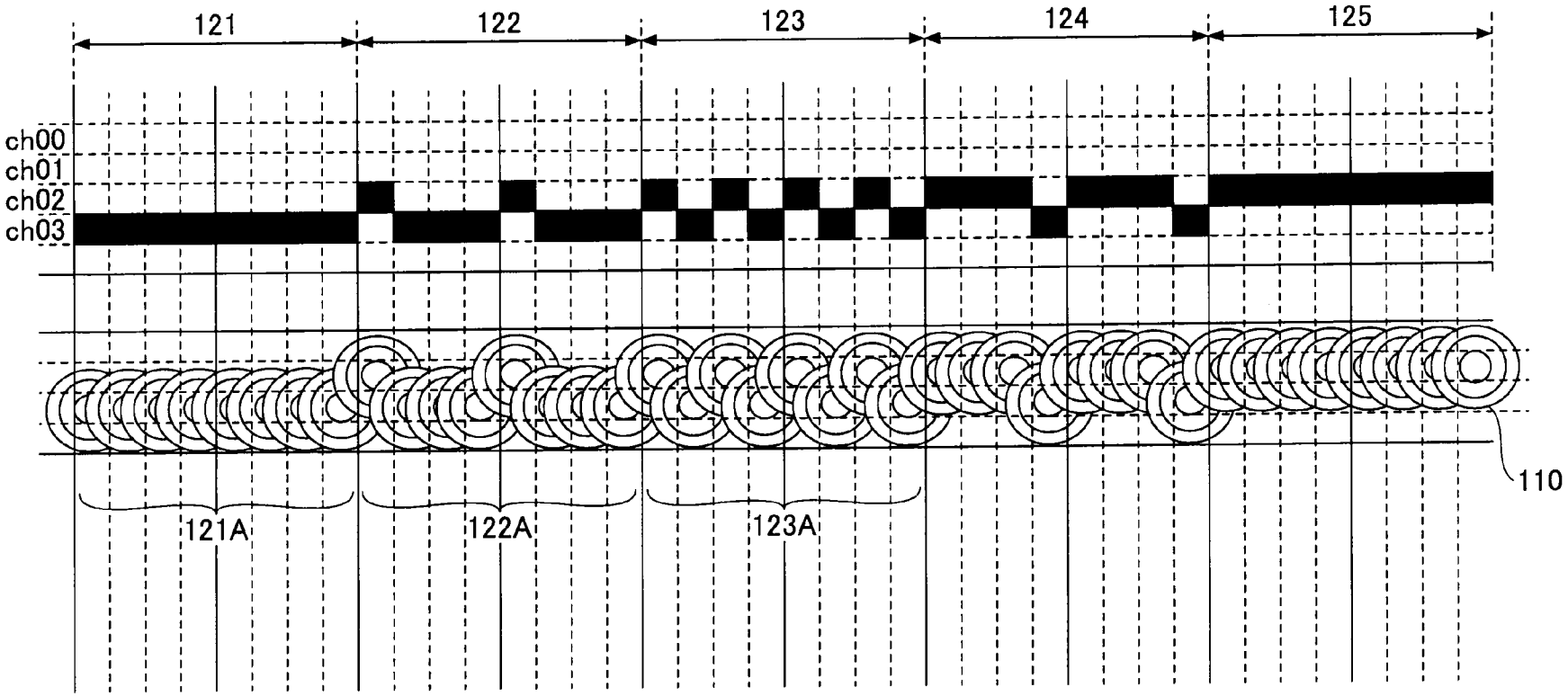
FIG. 4 is a diagram showing switching of exposure time and forming of the electrostatic latent image line 110.

FIG. 4 is a diagram showing switching the exposure time and forming the electrostatic latent image line 110. In this embodiment, laser beams 42 to form four beam scanning lines 46 are sequentially turned off to switch the exposure time of the laser beams 42, and thereby the electrostatic latent image line 110 is formed. Note that grid lines are shown in FIG. 4 for convenience of description.

In this embodiment, digital laser irradiation addresses are formed at high density so that the adjacent addresses to indicate light emission positions are set at intervals less than a laser spot diameter. Accordingly, laser beams outputted from the channels of the LDA 45 are overlapped to form one continuous electrostatic latent image line 110.

In section 121, for example, the controller 50 makes the laser beam ch03 emit light with 100% exposure time. Then, the trajectory of the laser beam ch03 is formed as shown by a trajectory 121A. Subsequently, in section 122, the controller 50 sets exposure time of the laser beam ch02 to be 25% and exposure time of the laser beam ch03 to be 75%. Then, the trajectory formed by the laser beams ch02 and ch03 is formed as shown by a trajectory 122A. In a similar manner, in section 123, the controller 50 sets exposure times of the laser beams ch02 and ch03 to be 50% each. Then, the trajectory formed by the laser beams ch02 and ch03 is formed as shown by a trajectory 123A. Trajectories are similarly formed in sections 124 and 125.

In this manner, adjacent addresses to indicate light emission are set closer than the diameter of the laser spots in this embodiment, so that the laser spots of the trajectories of the laser beams ch00 through ch03 emitted in response to the addresses are overlapped with each other. In this embodiment, the continuous electrostatic latent image line 110 is formed of the overlapped laser spots of the trajectories of the laser beams.

In this case, the beam scanning lines 46 are scanned with inclination with respect to the electrostatic latent image line 110. Therefore, this scanning method is hereinafter called a geometrical bias scanning method or simply a bias scanning method. An amount of displacement caused by the inclined scanning of the beam scanning line from the electrostatic latent image line (the number of rasters) is called a bias pitch. In a scanning optical system without any distortion, when the bias pitch is set to match the number of beam channels scanned at the same time, an electrostatic latent image line crosses orthogonal to the vertical scanning line. When the bias pitch is set larger than the number of the simultaneous scanning beam channels, the electrostatic latent image line is inclined diagonally to the right and down (as viewed on paper) while the electrostatic latent image line is inclined diagonally to the right and up (as viewed on paper) when the bias pitch is set smaller than the number of the simultaneous scanning beam channels.

By this bias scanning method, half of the channels of the LDA 45 can be turned off (¼ as a load) in one scan even in solid printing, that is a maximum loaded state. Moreover, it is assured that the plural channels are cyclically switched on/off. In particular, an effect of droop caused on a scanning line, which cannot be corrected by APC, is moderated.

Note that APC (Automatic Power Control) is a generally used method to detect and correct laser intensity at every scan outside a drawing area of the scanning line. According to this embodiment, an effect of droop can be moderated in the drawing area of a scanning line, which cannot be corrected by using the APC.

In this embodiment, timings to switch the exposure time or addresses to indicate light emission of the laser beams are set in the controller 50 in advance. These are set based on the degree of skew generated in the image forming apparatus 100 and the inclination of the LDA 45 with respect to the main scanning direction on the photosensitive body drum 10. In this embodiment, skew can be moderated to be as little as possible by appropriately setting the timing to switch the exposure time or the addresses to indicate light emission of the laser beams.

Below, processes of the controller 50 are described.

Figure 5:
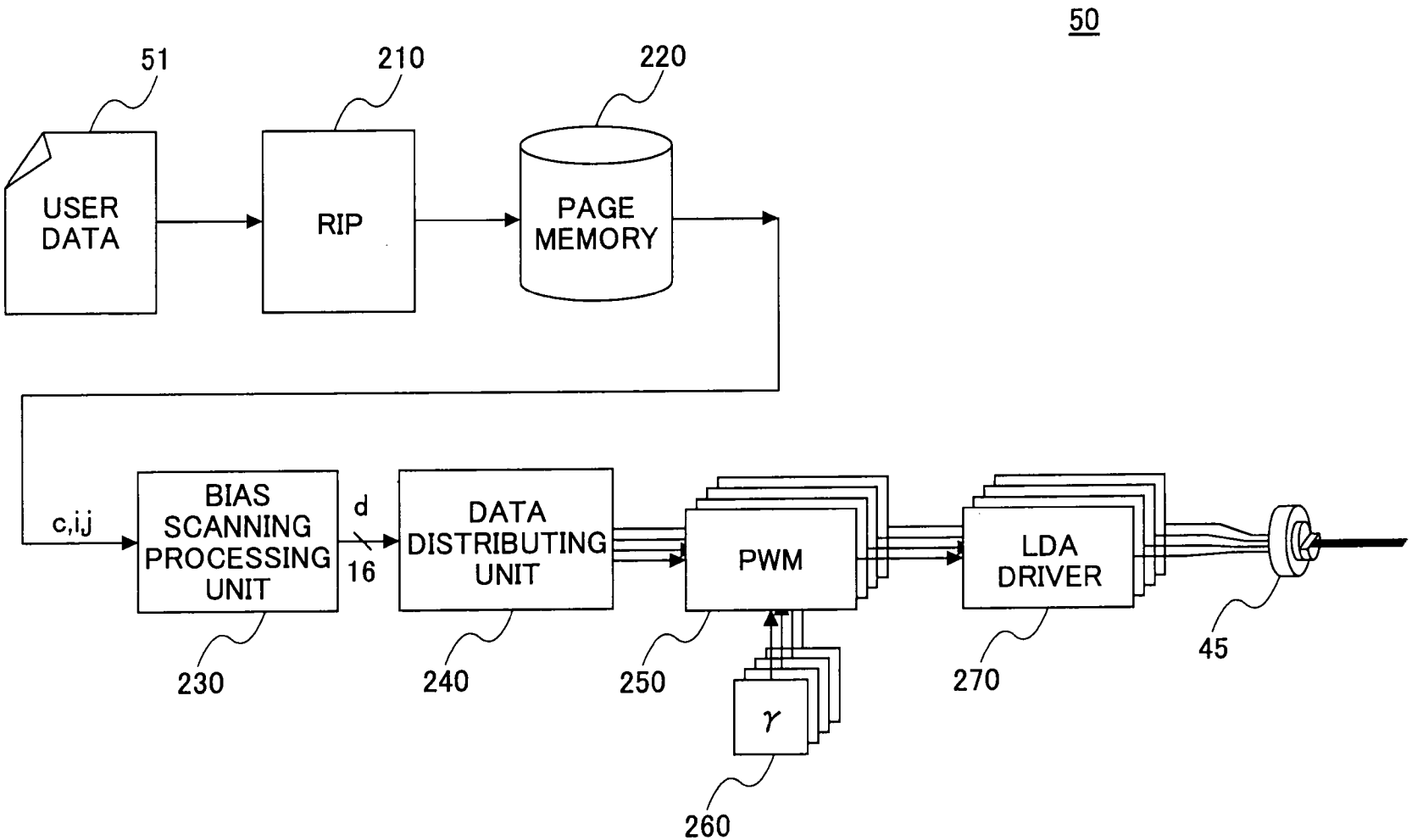
FIG. 5 is a diagram showing a process flow of a controller 50.

FIG. 5 is a diagram showing a process flow of the controller 50. The controller 50 of this embodiment manages an image forming process to put input data into an image, controlling the laser unit 40, and the like.

The controller 50 includes an RIP (Raster Image Processor) unit 210, a page memory 220, a bias scanning processing unit 230, a data distributing unit 240, PWM (Pulse Width Modulation) processing units 250, γ tables 260, and LDA drivers 270. User data 51 are inputted to the controller 50 and undergo an imaging process by these units. The user data 51 include a font, vector data such as a graph, a bit map (photograph and image), management information of these data, and the like mixed together.

The RIP unit 210 extends the page data included in the user data 51 into a bit map image of 1200 dpi data resolution and 2 bpp (bits per pixel) per page.

Here, the RIP unit 210 has a screening unit. The RIP unit 210 converts an image area using a lot of gradations such as a photograph and a business graph into a dot image by the screening unit in order to compensate for an insufficient gradation property of the 2 bpp image. The data formed into the 2 bpp image by the RIP unit 210 are accumulated as image data c in the page memory 220.

The bias scanning processing unit 230 receives a column address value i and a row address value j of the image data c from the page memory 220 to generate 16-bit data d including four pieces of 4 bpp data which have undergone a bias scanning process. The process by the bias scanning processing unit 230 is described in detail below. The data distributing unit 240 performs a process to distribute the data d from the bias scanning processing unit 230 for every raster to the PWM processing units 250 provided for each of the forty (shown as four in FIG. 5) output channels.

Each of the PWM processing units 250 references the corresponding γ table 260 and allocates the 4 bpp data to each pulse pattern selected from 32 stages of pulse widths. Then, the PWM processing unit 250 sends out the pulse pattern as a serial signal p to the LDA driver 270 of each channel.

FIG. 15 shows an example of the γ table 260. The γ table 260 is provided to finely control lengths of pulses while holding the pulse pattern given as a 4-bit input signal. In the example of FIG. 15, outputs corresponding to input values (0001), (0100), and the like having short on-times are corrected so that the on-times become longer in view of a response delay of a laser.

Note that the LDA drivers 270 are provided for the every forty (shown as four in FIG. 5) output channels in a similar manner to the PWM processing units 250. Moreover, the γ tables 260 are stored in a memory device and the like included in the controller 50 in advance. The LDA drivers 270 drive laser diodes of the corresponding output channels of the LDA 45 in response to the serial signals p outputted from the PWM processing units 250.

Next, a detail of the bias scanning processing unit 230 is described.

Figure 7:
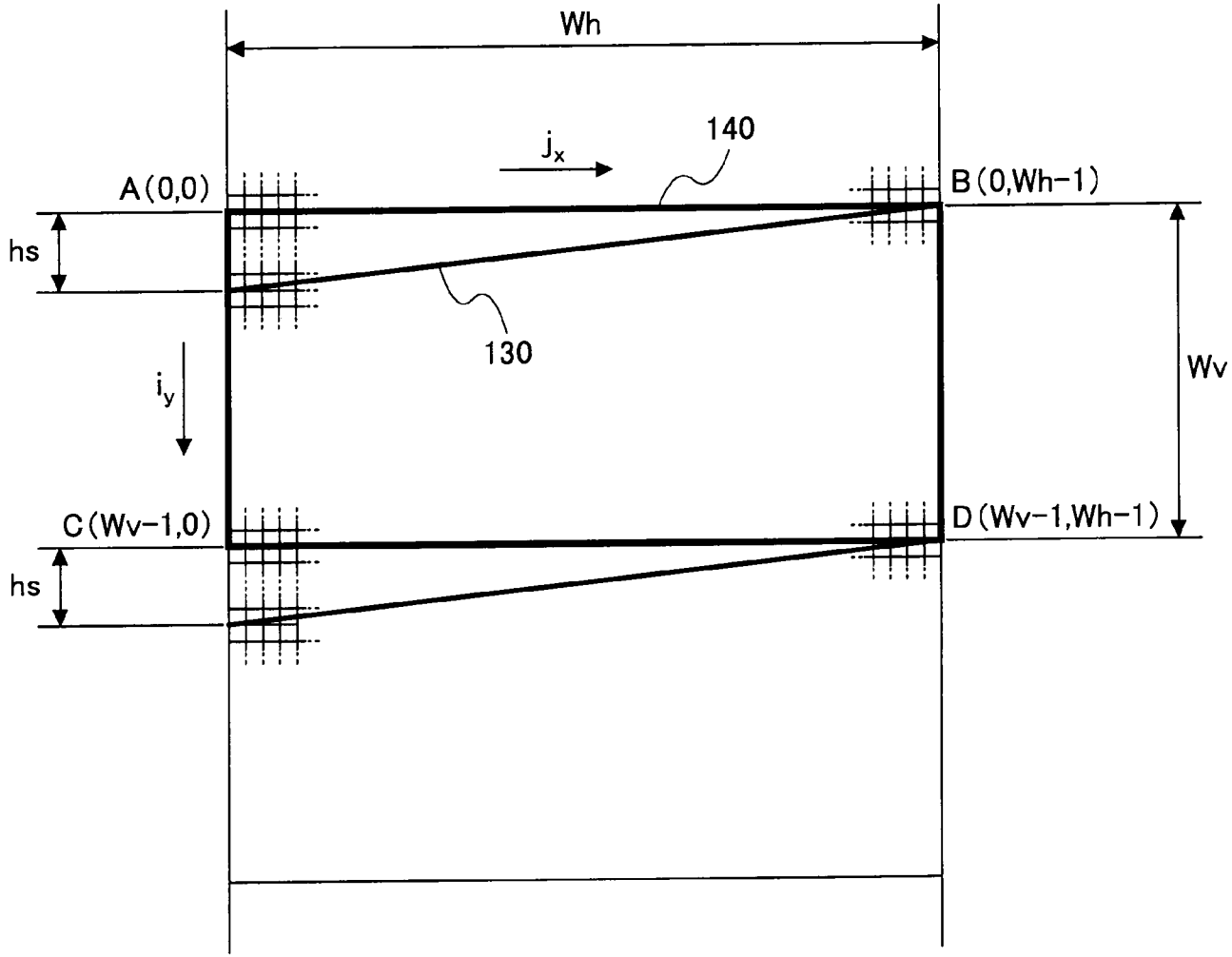
FIG. 7 is a schematic diagram showing an address space 140 of a buffer memory included in a bias scanning processing unit 230.

Prior to describing a process executed by the bias scanning processing unit 230, a buffer memory included in the bias scanning processing unit 230 is described. FIG. 7 is a schematic diagram of an address space 140 of the buffer memory included in the bias scanning processing unit 230.

The buffer memory is in a two-dimensional array, which can be randomly accessed. A direction of an arrow $j_x$ corresponds to a main scanning direction and a direction of an arrow $i_y$ corresponds to a vertical scanning direction in FIG. 7.

A region of an area ABCD in FIG. 7 is an area allocated to an actual buffer memory. A width Wh corresponds to the number of pixels of page data in the main scanning direction. On the other hand, a redundancy corresponding to a ratio of an electrostatic latent image line pitch to a beam scanning line pitch which is described below, is required to be provided in the vertical scanning direction. Therefore, addresses of a multiple of the redundancy of the input page data or more are required, which increases required memory.

To prevent an increase in cost due to the increased memory, hs is a bias pitch, and a width Wv in the vertical scanning direction is set as a multiple of the redundancy (in this case equal to four), which is enough to hold ((the number of beam channels)×(the redundancy)). As for a vertical scanning address i of the image data c from the page memory 220, a remainder of ((redundancy)×(the vertical scanning address i)) modulo the width Wv corresponds to a vertical scanning direction address of the address space 140.

The bias scanning processing unit 230 realizes a bias scanning method by rearranging raster data of the page memory 220 to have an inclination of hs/Wh as shown by auxiliary line 130 by using the address space 140 of the buffer memory.

Figure 8:
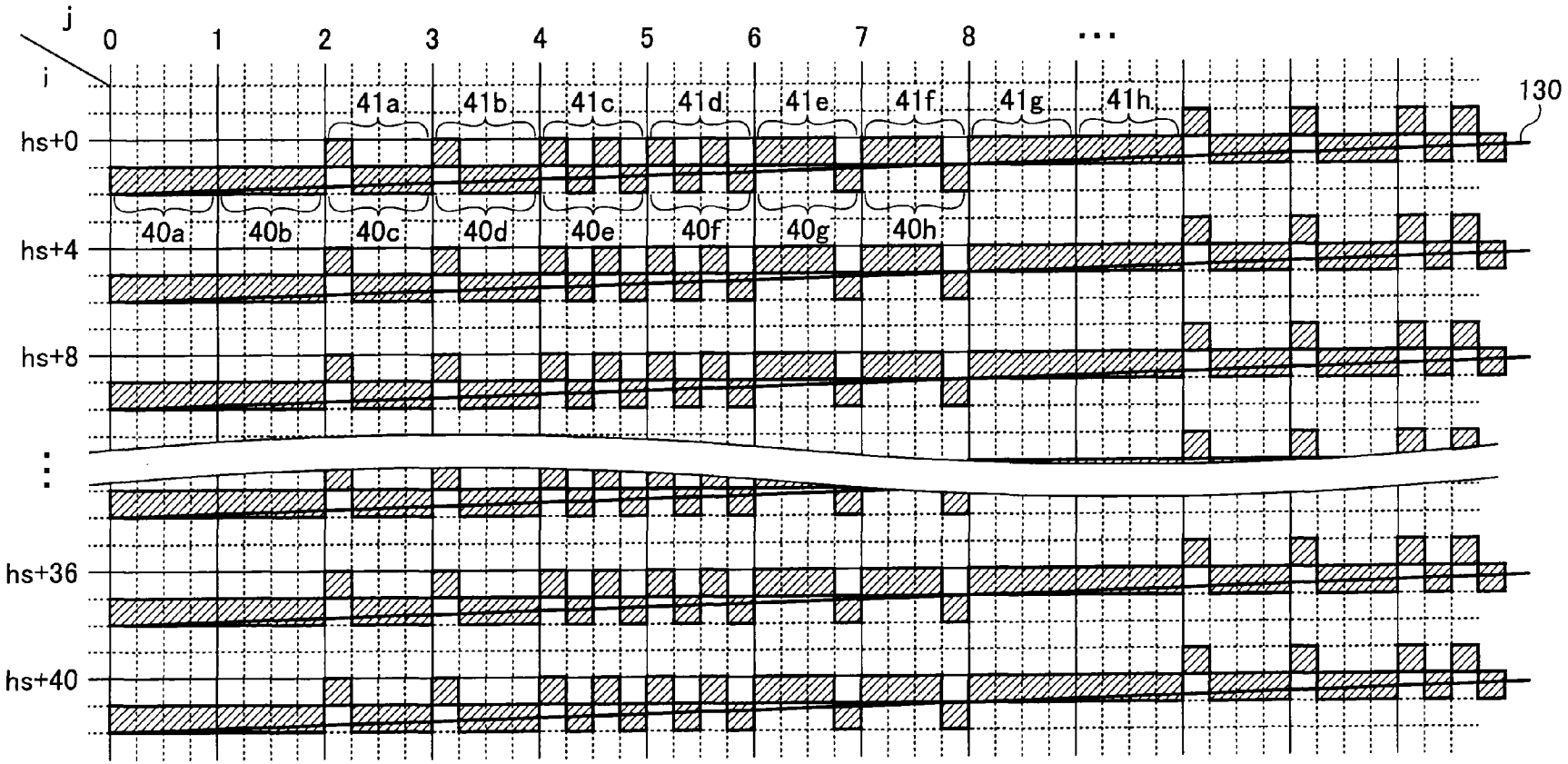
FIG. 8 is a diagram showing a detail of rearrangement of data in the address space 140.

FIG. 8 shows a detail of the rearrangement of the data into the address space 140. A minimum grid (dotted line) in FIG. 8 corresponds to one pixel at a device resolution of 4800 dpi. The minimum grids of 4×4 (solid line) correspond to one pixel at a data resolution of 1200 dpi. Further, addresses shown by hatching indicate dots (value 1) that are turned on while other addresses indicate dots (value 0) that are turned off in solid printing.

First, 2-bit values of the image data c undergo a process to duplicate each bit. Specifically, a process to make 2-bit values (00) into (0000), (01) into (0011), (10) into (1100), and (11) into (1111) is performed to convert the 2-bit data into 4-bit data. The 4-bit data are arranged sequentially from the top of a raster as shown in sections 40*a* through 40*h*.

To realize the exposure energy ratio corresponding to section 122 of FIG. 3, an AND value of an input pixel value and a mask value (0111) is arranged in section 40*c* and an AND value of the input pixel value and a mask value (1000) is arranged in section 41*a* instead.

Accordingly, an exposure duty in the case of solid printing is distributed into 3:1 by the mask value (0111) between sections 40*c* and 41*a* on the adjacent rasters (i=hs+1 and i=hs+2) while maintaining a duty of a 4-bit image value as a whole. Relationships between sections 40*d* and 41*b*, 40*e* and 41*c*, 40*f* and 41*d*, and the like are similar to this.

The four stages of mask values (1111), (0111), (0101), and (0001) to distribute the duty are selected depending on a relationship with auxiliary line 130. A specific method is described with reference to FIG. 9.

Figure 9:
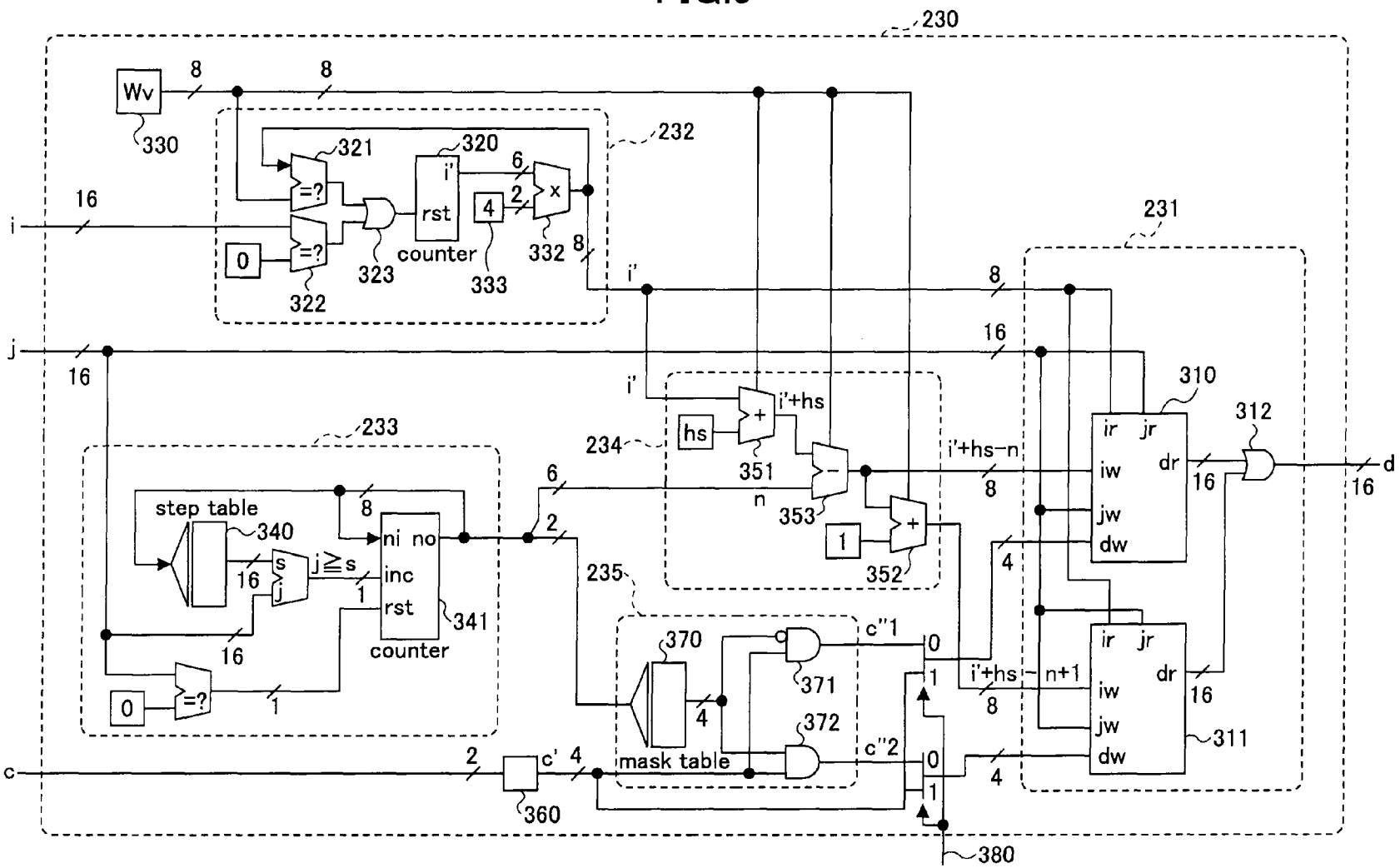
FIG. 9 is a block diagram of a bias scanning processing unit 230.

FIG. 9 is a block diagram of the bias scanning processing unit 230. Note that each component in FIG. 9 is a synchronization circuit using a read unit time of the image data c as a synchronization clock. However, the synchronization clock, a register to control delay, and the like are omitted to simplify the description. In the following description, a signal value 1 corresponds to a dot that is turned on while a signal value 0 corresponds to a dot that is turned off.

The bias scanning processing unit 230 mainly includes a buffer memory unit 231, a vertical scanning address generating unit 232, a shift parameter generating unit 233, an address shifting unit 234, and a mask processing unit 235.

The buffer memory unit 231 is formed of buffer memories 310 and 311. In both of the buffer memories 310 and 311, iw, jw, ir, jr, dw, and dr correspond to a write vertical scanning address, a write main scanning address, a read vertical scanning address, a read main scanning address, write data, and read data, respectively. By an OR circuit 312, an OR value of output values of these buffer memories is obtained. As a result, data with different write vertical scanning addresses are simultaneously written. The contents of these buffer memories are cleared prior to starting a process by zero data sent in advance and the like.

The vertical scanning address generating unit 232 generates a remainder i' obtained by dividing 4*i* by the width Wv of the vertical scanning direction in order to map the vertical scanning address i from the page memory in the address space 140. This generation is easily realized by resetting an internal counter 320 which counts up in accordance with synchronization clocks to 0 by setting i=0 or i'=Wv by a combination of comparator circuits 321 and 322, and an OR circuit 323. Here, Wv denotes a vertical scanning width value of the address space 140 which is set in advance in a register 330. A 6-bit output of this internal counter 320 is multiplied with a redundancy "4" (a ratio of the electrostatic latent image pitch to the beam scanning line pitch) set in a register 333 by a multiplying circuit 332 to generate i'.

In this case, since a start value i=0 of the vertical scanning address i is only used as a reset flag, any signals that can be used as a reset flag to recognize a start of a page can be used instead of the vertical scanning address i.

The shift parameter generating unit 233 generates an 8-bit shift parameter value n that determines an amount to shift the write vertical scanning address in response to the main scanning address j. This shift parameter n functions to arrange write addresses along auxiliary line 130 of FIG. 8. In particular, high-order 6 bits of the shift parameter n determine an amount of shift of the write address conducted by the address shifting unit 234, while low-order 2 bits are used as a mask selection signal to distribute an exposure duty between adjacent rasters in the mask processing unit 235.

A step table 340 of the shift parameter generating unit 233 is an LUT (Look Up Table) capable of downloading 256 entries. Main scanning address positions si (i=0, 1, 2, . . . ) to switch a mask, where a pixel is off, are registered in an ascending order in the step table 340 in advance. The main scanning address positions are s0=2, s1=4, and s2=6, . . . in FIG. 8.

Further, a counter 341 is a logic circuit. When a 1-bit input value inc=1 is satisfied, the counter 341 increments an 8-bit input count value ni to be outputted as a signal of "no" in response to a synchronization clock. When inc=0 is satisfied, the counter 341 outputs a value of ni as it is as the signal of no. In particular, when a 1-bit input value rst=0 is satisfied, a signal of no=0 is outputted regardless of ni. In this configuration, when the main scanning counter value j=0 is satisfied, the counter 341 outputs an output of no=0. Thus, s=s0 is set by the step table 340. While j<s0 is satisfied, the signal "no" does not change. When j=s0 is satisfied, the signal "no" is incremented and the signal "no" becomes 1. At the same time, a next step value s1 is referenced from the step table 340. Continuing, the signal "no" is incremented by each of the main scanning address positions s0, s1, s2, . . . registered in the step table 340 in a similar manner.

In the address shifting unit 234, a vertical scanning write address iw=i'+hs−n for the buffer memory 310 and a vertical scanning write address iw=i'+hs−n+1 for the buffer memory 311 are obtained by the output i' of the vertical scanning address generating unit 232 and the high-order 6 bits n of the output "no" corresponding to an integer part of the shift parameter no/4. These addresses have to be calculated as remainders modulo the vertical scanning width value Wv of the address space set in the register 330. Therefore, adder circuits 351 and 352, and a subtraction circuit 353 employ an adder circuit with a restriction shown in FIG. 10 and a subtraction circuit with a restriction shown in FIG. 11, respectively.

A bit extending unit 360 outputs a 4-bit extension pixel value c' formed by duplicating each bit of the 2-bit value of the image data c as described with reference to FIG. 8.

The mask processing unit 235 references a mask table 370 by using the low-order 2 bits of the shift parameter n as an index. In this mask table 370, mask values (1111), (0111), (0101), and (0001) to determine distribution of the exposure duty between rasters with adjacent write addresses calculated by the address shifting unit 234 as shown in FIG. 8 are registered in this order.

An AND circuit 371 calculates an AND value of an inverted value of a mask value selected in the mask table 370 and the extension pixel value c', to determine a value c"1 written in the buffer memory 310. In a similar manner, an AND circuit 372 calculates an AND value of the mask value selected in the mask table 370 and the extension pixel value c', to determine a value c"2 written in the buffer memory 311. A selection signal 380 is set equal to 0 as a default. The output values c"1 and c"2 of the mask processor 235 are sent to the buffer memory unit 231 as they are.

When reading out data from the buffer memory unit 231, 16-bit data formed of 4 rows of 4-bit data, which are (ir, jr), (ir+1, jr), (ir+2, jr), and (ir+3, jr) are read out all at once from the data written in the buffer memories 310 and 311, by using the input vertical scanning address j from the page memory as "a read main scanning address jr" and using i' from the vertical scanning address generating unit as "a read vertical scanning address ir". The data read out from the buffer memories 310 and 311 are combined by the OR circuit 312 to be an OR value of each pair of corresponding bits.

Accordingly, a row hs and the like remain unread in the buffer memories 310 and 311 after the data have been read out. Therefore, null data of hs/4 rows or more are added as dummy data at an end of the page data to prevent generation of the unread data.

In the aforementioned description, the redundancy of the register 333 (a ratio of the electrostatic latent image line pitch to the beam scanning line pitch in the vertical scanning direction) is a multiple of four, however, another redundancy may be set as well. In the circuit example shown in FIG. 9, by setting the value of the register 333 to be 2 or 3 and extracting only an effective part of the output data d of the OR circuit 312 by the data distributing unit 240 shown in FIG. 5, the redundancy is easily changed to be a multiple of two or three.

Further, when there is a channel with a light emission defect in the LDA 45, the value of the selection signal 380 in FIG. 9 is switched to 1. With this configuration, the same data can be outputted by two adjacent channels at all times without being processed by the mask processing unit 235. Accordingly, a lack of drawing data can be prevented. In accordance with this switching, the γ tables 260 of the corresponding PWM processors 250 in FIG. 5 are switched. As a result, variation in color density of an image is moderated.

Figure 10:
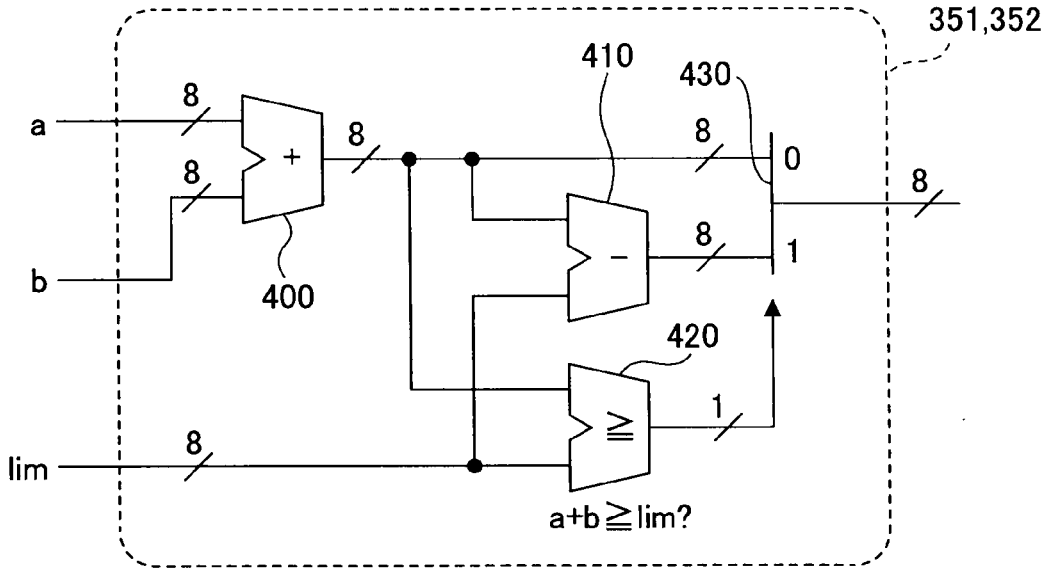
FIG. 10 is a diagram showing an example of adder circuits 351 and 352 with restrictions.

FIG. 10 shows an example of the adder circuits 351 and 352 with the restriction. An adder circuit 400 outputs an addition a+b of input values a and b. A subtraction circuit 410 outputs an output of a+b−lim. A comparator circuit 420 compares a limit value lim and the addition a+b to output a selection signal. A selection circuit 430 selects and outputs a+b−lim when a+b>lim is satisfied and selects and outputs a+b in other cases. Accordingly, an output equivalent to a remainder obtained by dividing a+b by lim is obtained by the circuit shown in FIG. 10 when the input values a and b satisfy 0≦a, b<lim.

Figure 11:
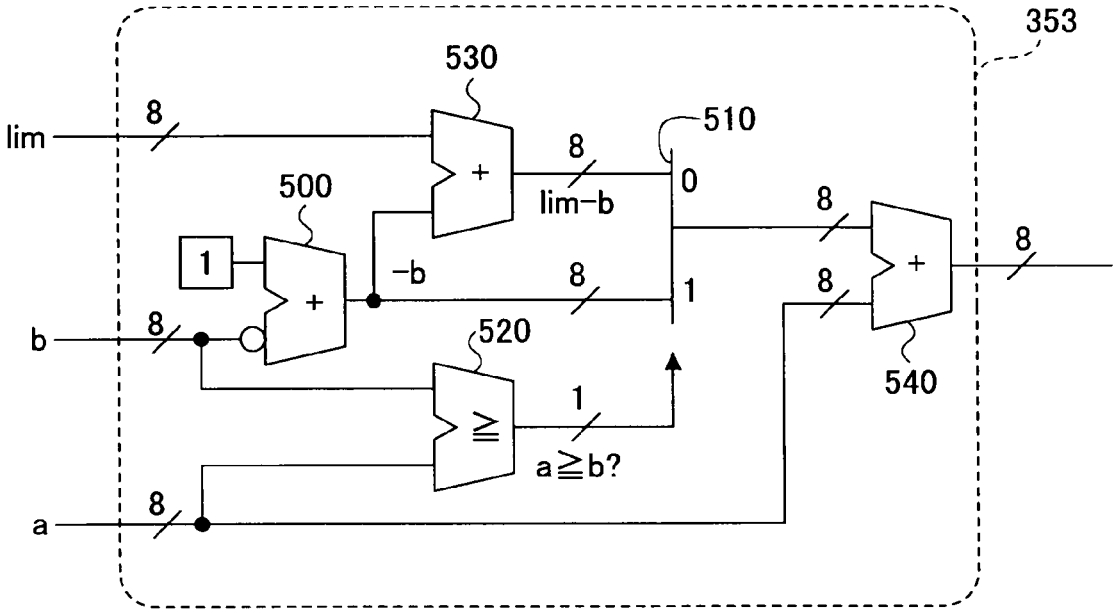
FIG. 11 is a diagram showing an example of a subtraction circuit 353 with a restriction.

FIG. 11 shows, similarly, an example of the subtraction circuit 353 with the restriction. A complement circuit 500 logically inverts an input value b and adds 1 to the inverted input value b to generate a complement of b corresponding to −b. In combination with a comparator circuit 520, a selection circuit 510 selects an output lim−b of an adder circuit 530 when a<b is satisfied between the input values a and b, and selects −b when a≧b is satisfied. An adder circuit 540 adds a to an output of the selection circuit 510. Accordingly, an output equivalent to a remainder obtained by dividing a−b by lim is obtained by the circuit shown in FIG. 11 when the both input values a and b satisfy 0≦a, b<lim.

Figure 12:
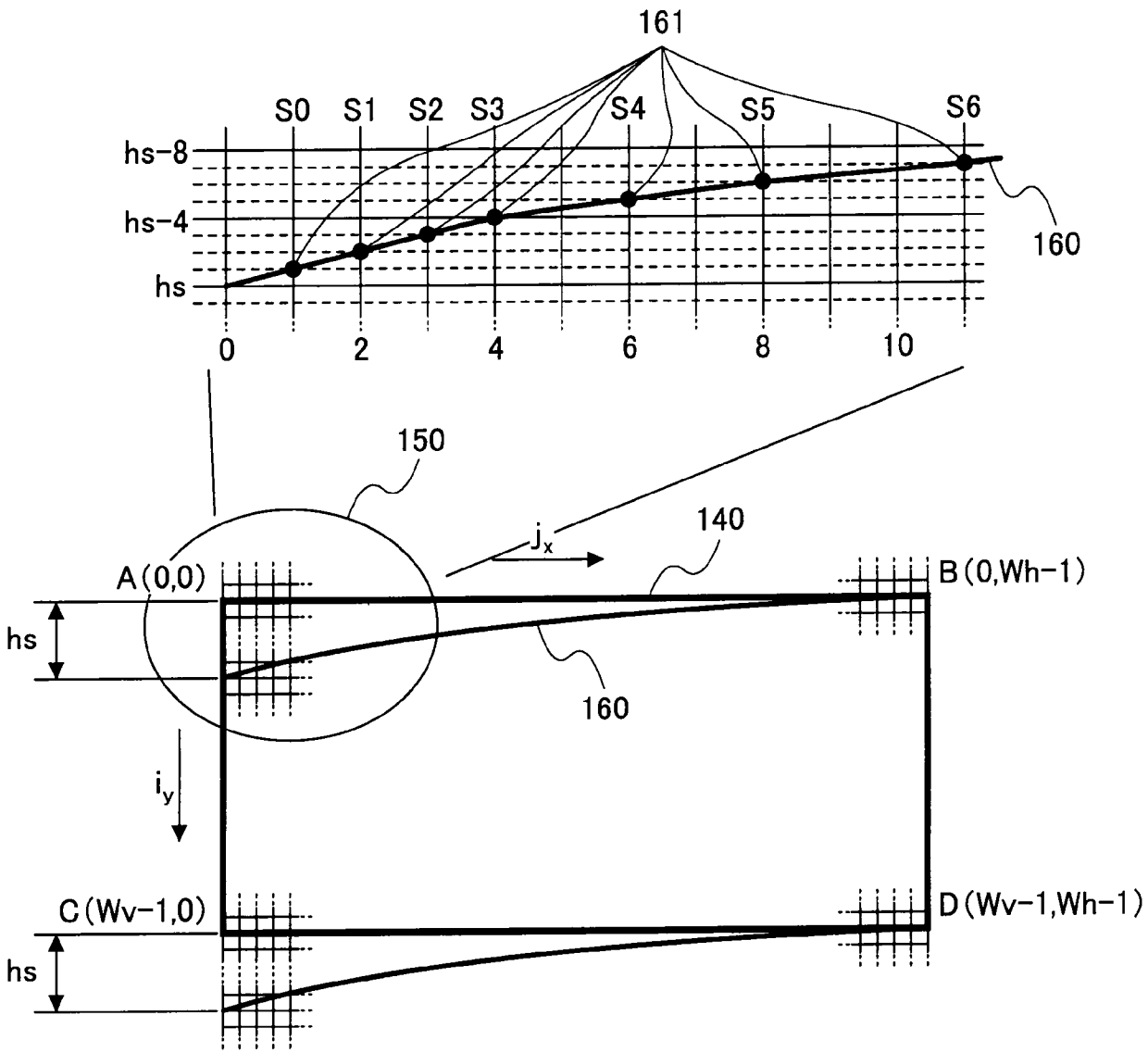
FIG. 12 is a diagram showing a concept of a set value in a step table 340 when also performing bow correction.

FIG. 12 shows a concept of set values of the step table 340 when performing bow correction in combination. An upper diagram of FIG. 12 is an enlarged diagram of an area 150 in the address space 140 shown below.

When performing the bow correction, the trajectory of a raster on the address space 140 is an approximately straight line 160 formed by approximating displacement in an opposite direction to displacement in the vertical scanning direction of a beam scanning line 46 formed on the photosensitive body drum 10.

The set values of the step table 340 are obtained by registering intersections 161 of the approximately straight line 160 with grids of the main scanning direction in an ascending order.

With this method, there is a restriction in that the approximately straight line 160 is a monotone function of the main scanning address j. That is, a distortion can be corrected by this correction method only when displacement caused by a combination of bow and skew to be corrected is a monotone function of a position in the main scanning direction on the photosensitive body drum 10. However, the amount of displacement in the vertical scanning direction is as small as about several hundreds μm, which is smaller than that of a conventional technique. Therefore, monotonicity of the displacement amount in the vertical scanning direction can be achieved by arranging the optical system so that a scanning line of a scanning optical system has a certain amount of skew even when a large extent of bow correction is required.

In the above description, the method to distribute the exposure time as shown in FIG. 3 is mainly described as a method to distribute exposure energy between the rasters. By improving this embodiment as described below, distribution of the exposure energy by distributing laser exposure intensity as shown in FIG. 13 can be easily performed.

Figure 13:
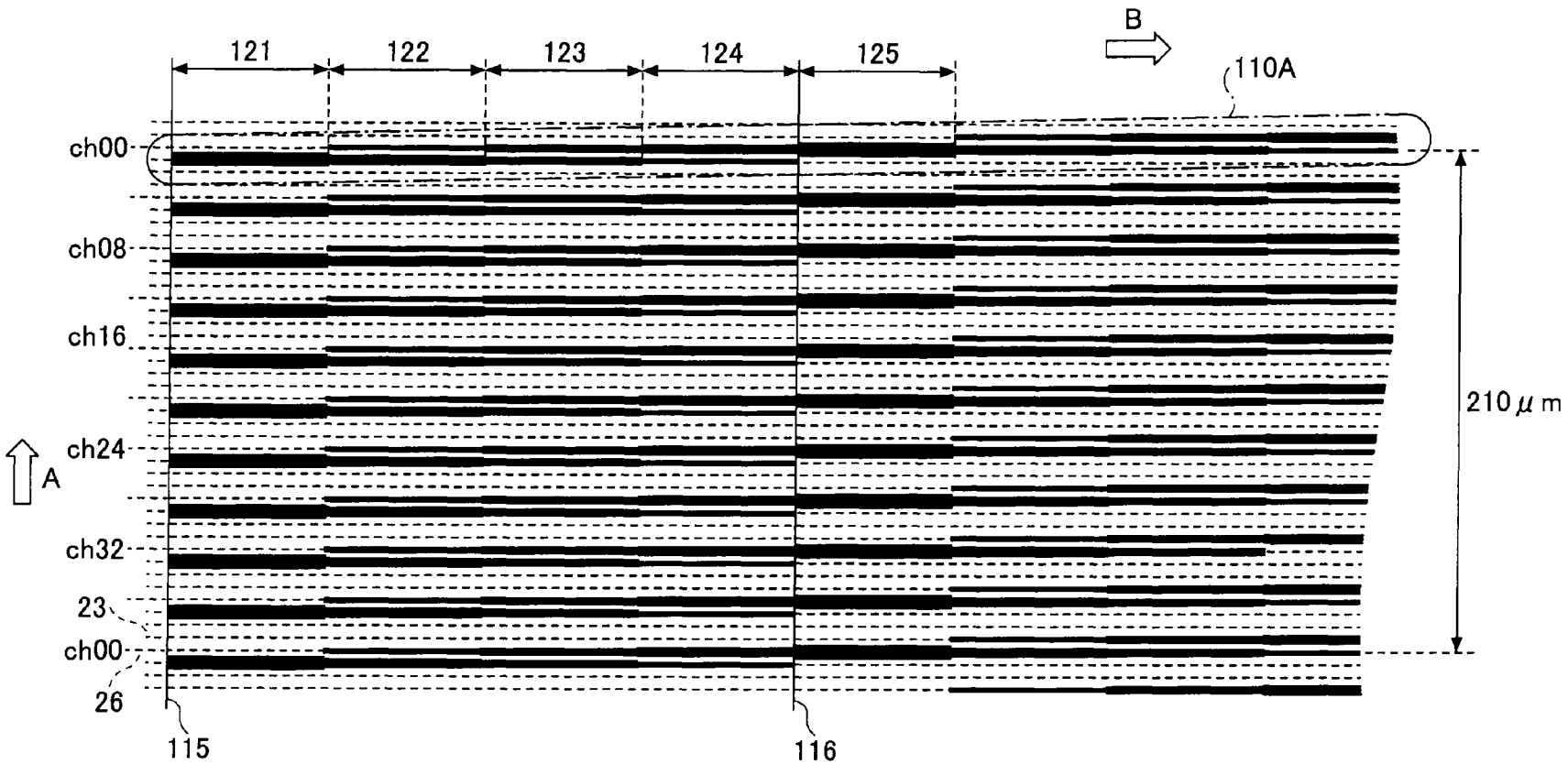
FIG. 13 is a diagram showing distribution of exposure energy by exposure intensity.

FIG. 13 is a diagram showing the exposure energy distributed by exposure intensity. In FIG. 13, the exposure intensities of the channels are switched between sections. For example, the exposure intensity of the laser beam ch01 is 100% in section 121 while other channels are turned off. In section 122, the exposure intensities of the laser beams ch01 and ch00 are 75% and 25% respectively while other channels are turned off. In section 123, the exposure intensities of the laser beams ch01 and ch00 are 50% each while other channels are turned off.

Figure 14:
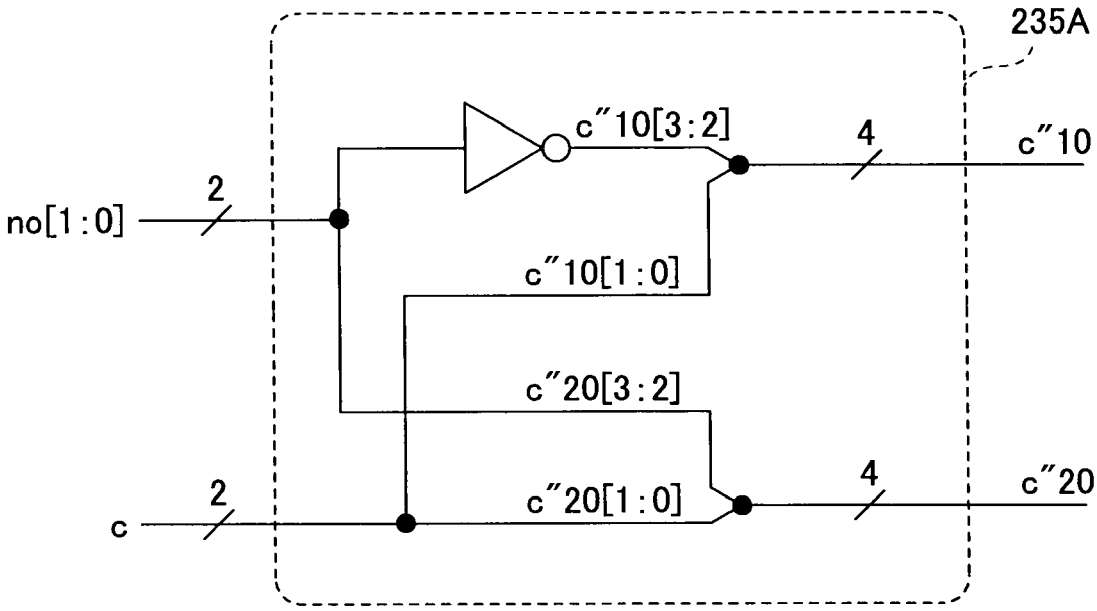
FIG. 14 is a diagram showing a circuit 235A as a replacement of a mask processing unit 235.

To realize this switching of the exposure intensities, the mask processing unit 235 shown in FIG. 9 is replaced by a circuit 235A shown in FIG. 14. In this case, the bit extending unit 360 shown in FIG. 9 is omitted. Then, a signal no[1:0] corresponding to the low-order 2 bits of the output signal "no" of the counter 341 is attached as it is as high-order 2 bits of the 2-bit value of the image data c to function as a beam intensity selection signal, to produce an output value c"10. A signal to which an inverted signal of the signal no[1:0] is attached corresponds to an output value c"20.

In accordance with these changes, the LDA driver 270 shown in FIG. 5 has four drivers corresponding to the intensities of 25%, 50%, 75%, and 100% for each channel. The PWM processing unit 250 shown in FIG. 5 selects a PWM pattern in response to low-order 2 bits of the 4-bit data of each pixel. The PWM processing unit 250 switches output destinations of the four LDA drivers 270 in response to the beam intensity selection signal allocated as the high-order 2 bits. FIG. 6 shows an example of the γ table 260 in this case.

According to one embodiment, droop can be reduced and skew can be moderated even when the number of beam channels is increased.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teachings herein set forth.

The present invention can be used for an image forming apparatus employing a method to perform scanning of plural beams at the same time.

This patent application is based on Japanese Priority Patent Application No. 2008-053805 filed on Mar. 4, 2008, and Japanese Priority Patent Application No. 2009-027557 filed on Feb. 9, 2009, the entire contents of which are hereby incorporated herein by reference.

What is claimed is:

1. An optical-scanning image forming apparatus comprising:

a laser array light source having plural laser light sources for emitting plural laser beams;

a photosensitive body having a surface on which a single electrostatic latent image is formed by a surface potential changed by scanning the plural laser beams emitted from the laser array light source; and a controller for controlling the emission of the plural laser beams of the laser array light source, wherein the plural laser light sources are formed so that the electrostatic latent image is formed in a direction nonparallel to a main scanning direction in a region where the electrostatic latent image is formed on the surface of the photosentitive body, plural laser spots of the plural laser beams are overlapped with each other in a sub-scanning direction so that solid printing can be performed even when only one of plural laser light sources is turned on, and the controller sequentially turns off at least one of the plural laser beams when forming the single continuous electrostatic latent image line on the photosensitive body by scanning the plural laser beams in the main scanning direction of the photosensitive body.

2. The optical-scanning image forming apparatus as claimed in claim 1, further comprising a bias scanning processing unit for displacing the electrostatic latent image line in a vertical scanning direction, wherein the controller includes a rewritable table storing one or more addresses in the main scanning direction to indicate the displacement; and the bias scanning processing unit displaces the electrostatic latent image line in the vertical scanning direction according to the rewritable table.

3. The optical-scanning image forming apparatus as claimed in claim 1, wherein when any one of the plural laser light sources becomes inoperable, the controller makes a laser light source arranged adjacent to the inoperable laser light source emit a laser beam instead of the inoperable laser light source.

4. The optical-scanning image forming apparatus as claimed in claim 1, wherein the laser array light source is an edge emitting type laser array light source including the plural laser light sources having linearly arranged laser emitting apertures.

5. The optical-scanning image forming apparatus as claimed in claim 1, wherein the continuous electrostatic latent image line is formed by switching exposure intensities of the laser light sources.

6. An optical-scanning image forming apparatus comprising:

a laser array light source having plural (n, n: an integer greater than zero) laser light sources for emitting plural laser beams;

a photosensitive body having a surface on which a single electrostatic latent image is formed by a surface potential changed by scanning the plural laser beams emitted from the laser array light source; and a controller for controlling the emission of the plural laser beams of the laser array light source, wherein the plural (n) laser light sources are divided into plural (m, m: an integer greater than zero and less than n) groups, the plural (n) laser light sources in each group are formed so that the electrostatic latent image is formed in a direction nonparallel to a main scanning direction in a region where the electrostatic latent image is formed on the surface of the photosensitive body, plural laser spots of the plural laser beams are overlapped with each other in a sub-scanning direction so that solid printing can be performed even when only one of plural laser light sources in each group is turned on, and the controller sequentially turns off at least one of the plural laser beams when forming a single continuous electrostatic latent image line on the photosensitive body by scanning the plural laser beams in the main scanning direction of the photosensitive body.

7. The optical-scanning image forming apparatus as claimed in claim 6, wherein a number of the laser light sources is 40 (n=40), and a number of the group is 10 (m=10).

* * * * *